United States Patent [19]

Burnett, III

[11] 4,034,150

[45] July 5, 1977

[54] ACCORDIAN FOLD CABLE WITH FLEXIBLE CLIPS OVER THE FOLDS

[75] Inventor: Jack W. Burnett, III, Mauldin, S.C.

[73] Assignee: Southern Weaving Company, Greenville, S.C.

[22] Filed: Feb. 20, 1976

[21] Appl. No.: 659,775

[52] U.S. Cl. ..... 174/69; 24/243 K; 24/255 R

[51] Int. Cl.[2] ..... H01B 7/06

[58] Field of Search ..... 174/69, 135, DIG. 9; 191/12 R, 12 S; 24/115 R, 243 K, 255 R, 259 R; 138/110; 160/395, 399, 402; 267/144, 165; 312/273

[56] References Cited

UNITED STATES PATENTS

| | | | |
|---|---|---|---|
| 894,356 | 7/1908 | Walton | 24/243 K UX |
| 996,028 | 6/1911 | Palmer | 24/243 K UX |
| 1,362,651 | 12/1920 | Towns | 24/243 K UX |
| 3,266,711 | 8/1966 | Song | 24/243 K UX |
| 3,318,224 | 5/1967 | Bohanon | 24/243 K X |
| 3,476,870 | 11/1969 | Ross | 174/69 |
| 3,488,430 | 1/1970 | Holzhauser | 174/69 |

*Primary Examiner*—Laramie E. Askin
*Attorney, Agent, or Firm*—Bailey, Dority & Flint

[57] ABSTRACT

A device is disclosed for maintaining a conductor cable in an accordion fold configuration comprising a flexible clip member having opposing inclined sides terminating at a joint section receivable over the folds of the accordion cable with fastening means for securing and maintaining the apex of the fold within the clip member.

9 Claims, 4 Drawing Figures

ACCORDIAN FOLD CABLE WITH FLEXIBLE CLIPS OVER THE FOLDS

BACKGROUND OF THE INVENTION

Accordion cables with a prefolded and retractable configuration are advantageously used for placement within a slideable drawer to maintain electrical connection between one end of the drawer and an electrical panel at the remote end. As the drawer is moved outwardly and inwardly, the cable expands and retracts accordingly.

Prior to the present invention it has been the practice to provide retractable cables when are prefolded with permanent accordion folds by providing stiffened members along the straight portion between the loop portions of the folded cable and strain relief threads at each fold such as shown in U.S. Pat. No. 3,476,870. These cables are usually manufactured in accordance with customer specifications in a prefolded accordion configuration.

Although prefolded accordion cables with permanent folds have been manufactured, such has not made it possible for users of accordion cables to take a flat cable and construct a retractable accordion cable according to their own specification in field use.

It has also been known to fixedly clamp each of the fold portions of a retractable cable to maintain the cable in its prefolded configuration and to protect the cable from rubbing against the casing during expansible movements such as shown in United States Letters Patent No. 3,488,430. However, the disclosed cable clips are for sliding along the surface of the drawer casing to prevent the destruction of the insulation about the conductor wires, and do not provide a resilient force for retracting the cable and maintaining it in an accordion fold configuration.

SUMMARY OF THE INVENTION

A device is provided for maintaining a cable having a plurality of conductor wires in an accordion fold configuration wherein the folded cable has an open-loop configuration at each fold thereof. The device comprises a flexible clip member having opposing inclined side portions convergently extended and terminating at a joint section. The remote ends of the opposing side portions are spaced apart and arranged to be placed over a fold of the accordion cable with an apex of the open loop of the fold being nested adjacently within the joint section. A fastening means is provided for securing and maintaining the apex of the fold in the nested position within the clip member reducing the tendency of the fold to be removed therefrom during expansion of the cable. The opposite side portions are flexible inwardly and outwardly relative to each other so as to impart a retracting force to the cable following an expansion thereof. Thus, the cable is maintaining in its accordion fold configuration.

Accordingly, an important object of the present invention is to provide a device which is fastenable to a fold of an accordion fold cable to maintain the cable in an accordion fold configuration.

Another important object of the present invention is to provide a device which may be readily and conveniently utilized in field use for forming accordion fold cables thereby eliminating the need for a pre-manufactured folded cable.

Still another important object of the present invention is to provide a device having a flexible clip member which may be placed over the loop portion of a cable fold and fastened thereto and has sufficient flexibility to impart a retracting force to the folded cable to maintain it in an accordion configuration.

Another important object of the present invention is to provide a device comprising a flexible clip member and a fastening member which may be utilized in field use to construct an accordion cable from a flat cable member and the like.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

The device of the present invention may be utilized in the manufacture of prefolded accordion cable and in particular may be advantageously utilized in field use for forming an accordion fold cable from a flat woven cable and bonded, laminated and the like cables.

Figure 1:
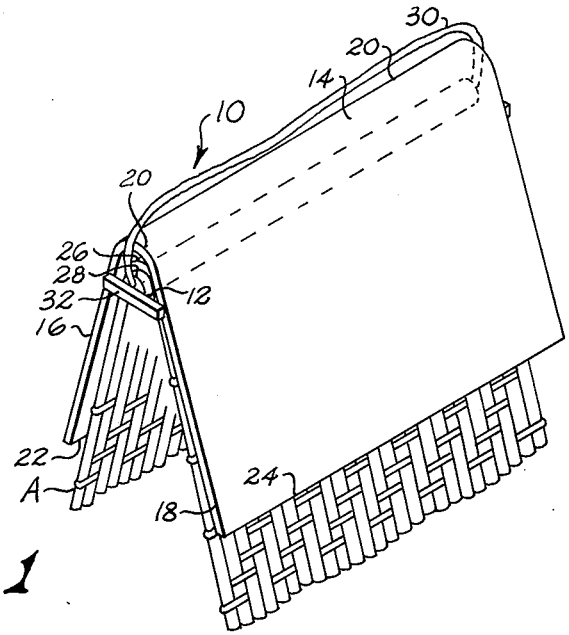
FIG. 1 is a perspective view illustrating a device constructed in accordance with the present invention for maintaining a folded conductor cable in an accordion fold configuration.

FIG. 1 of the drawing illustrates a device, designated generally at 10, for maintaining a cable A in an accordion fold configuration. The application of the preferred embodiment is with a woven cable A having a plurality of conductors in side-by-side arrangement. However, application of the invention to other types of cables is also possible. The folded accordion cable A has a substantially open loop configuration at each fold 12.

The device 10 includes a flexible clip member 14 having a pair of opposed inclined side portions 16 and 18 which converge towards each other and terminate at a joint section 20. The remote ends or edges 22 and 24 of the side portions 16 and 18, respectively, are spaced apart and arranged to be placed over the fold 12 of the cable A. An apex 26 of the open loop is nested adjacently within the joint section 20 of the clip member.

A fastening means for securing and maintaining the apex 26 of the fold 12 in its nested position within the joint section 20 of the clip member is provided by an elongated member 28. The elongated member 28 extends within the apex 26 of the open-loop of the fold 12. A retaining means 30 which is connected to the remote ends of the elongated member extends over an upper surface of the clip member to maintain the elongated member 28 in place. Thus, the cable A is sandwiched between the elongated member 28 and the joint section 20 of the flexible clip member. The fastening means 28 so positioned functions to keep the cable A from pulling out of the clip member during expansion thereof. The retaining means 30 is preferably an elastic member which may be stretched around the clip member.

The flexible clip member 14 preferably has an inverted V-shape and is constructed of a suitable flexible material such as a high impact and resilient plastic material or spring steel. The clip member 14 may be provided with a retaining bar or lip 32 on opposite ends thereof for preventing the elongated member 28 and the cable A from slipping out of the end of the clip member. In which instance, the remote ends of the elongated member 28 may be constructed to attach to the retaining bar 32 in any suitable manner eliminating the need for an elastic retaining member.

Figure 2:
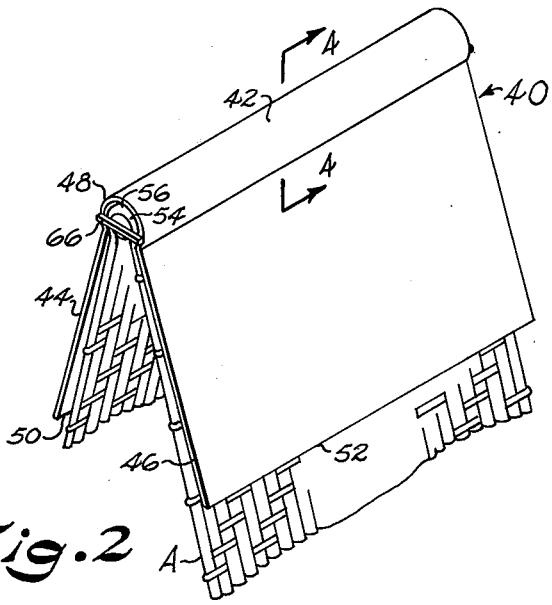
FIG. 2 is a perspective view illustrating another embodiment of a device for maintaining a folded conductor cable in an accordion fold configuration.
Figure 4:
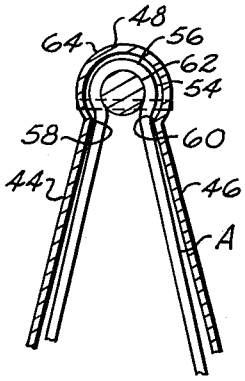
FIG. 4 is a front elevational sectional view taken along line 4—4 of FIG. 2.

FIG. 2 illustrates another embodiment of a device constructed in accordance with the present invention designated generally at 40. The device includes a flexible clip member 42 having a pair of opposed inclined sides 44 and 46 which convergently extend and terminate in a joint section 48. The remote ends or edges 50 and 52 of the opposing sides 44 and 46, respectively, are spaced apart and arranged to be placed over a fold 54 of the cable A. The fold 54 has a substantially open-loop configuration at the apex 56 thereof.

A pair of inwardly extending protuberances 58 and 60 are carried in opposing relationship by the opposing side portions 44 and 46, respectively. A fastening means is provided by an elongated dowel member 62 extending through the open loop of the fold 54 at the apex portion 56.

The joint section 48 preferably includes an enlarged head portion 64 which accommodates the apex portion 56 of the cable fold which extends above the protuberances 58 and 60. The protuberances 58 and 60 are thus respectively defined by the intersections of the opposing side portions 44 and 46 with the head portion 64.

The dowel member 62 reduces the tendency of the cable member A to be pulled past the protuberances 58 and 60 and thus out of the joint head 64 as the cable is pulled to expand. The clip member 42 may also include a retaining lip 66 formed on the remote ends thereof to prevent the dowel member 62 and the cable A from sliding laterally relative to the clip member.

The clip member 42 is preferably formed of a one-piece construction from any suitable material so as to enable the side portions 44 and 46 to flex outwardly and retract inwardly so as to impart a retracting force to the folds of the cable during the expansion thereof to maintain the cable in its accordion fold configuration.

Figure 3:
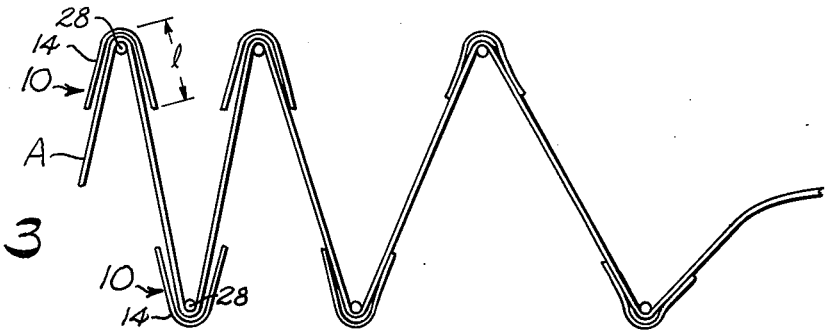
FIG. 3 is a schematic view illustrating a plurality of devices constructed in accordance with the present invention for maintaining a folded cable in an accordion fold configuration.

FIG. 3 of the drawing schematically illustrates a plurality of devices 10 constructed in accordance with the present invention as applied to a cable A to form an accordion fold cable. Such an application could be advantageously made in the field such as in the installation of computer and communication systems to convert a flat cable to an accordion cable. As illustrated, the device 10 flexes at different stages to permit the cable to expand and thereafter imparts a retracting force to the cable.

The size and dimensions of the clip member 14 would depend on the application. Most preferably, the clip member would have substantially the same width as the cable A although it could be somewhat narrower. The length l of the clip member would depend of the flexibility of the cable A. The more flexible the cable, the longer the length l would need to be to maintain the accordion fold configuration. If the cable A is positioned vertically in use, then the clip member 14 must have sufficient length to not only impart a retracting force, but to maintain the folded cable in an upright or vertical position reducing any tendency of the cable to double or fold upon itself. The flexibility of the cable would again be a factor in this dimension.

Thus, and advantageous construction of an accordion clip can be had in accordance with the present invention for placement over the fold of an accordion cable to retract and maintain the cable in its accordion fold configuration. The device of the present invention may be readily and conveniently utilized in field operations to convert a flat cable to an accordion cable by placing the flexible clip member over the folds of the cable and securing the clip in place with the fastening means. The clip member is highly effective in providing a retracting force to the cable after it is expanded to return the cable to its accordion configuration. Users of the present device may construct an accordion fold cable according to their own specification without the necessity of having such pre-manufactured.

While a preferred embodiment of the invention has been described using specific terms, such description is for illustrative purposes only, and it is to be understood that changes and variations may be made without departing from the spirit or scope of the following claims.

What is claimed is:

1. In combination, an accordion-fold cable having a plurality of conductor wires, said cable being folded to define an open-loop configuration at each fold thereof, a flexible clip device carried over a fold comprising:

opposing inclined side portions convergently extended and terminating at a joint section;

remote ends of said opposing side portions being spaced apart and arranged over a fold of said accordion cable with an apex of said open loop of said fold being nested adjacently within said joint section;

fastening means securing and maintaining said apex of said fold in said nested position within said joint section reducing the tendency of said fold to remove from said clip member during an expansion of said cable; and said opposing side portions being flexible inwardly and outwardly relative to each other so as to impart a retracting force to said cable following an expansion thereof;

whereby said cable may be maintained in its accordion fold configuration.

2. The combination of claim 1 wherein said clip member is constructed from a one piece flexible material enabling said opposing sides to flex outwardly and retract inwardly for expansion and retraction of said cable folds, respectively.

3. The combination of claim 2 wherein said joint section includes an enlarged head portion and a pair of inwardly extending protuberances in opposing relationship defined by the intersections of said opposing side portions and said head portion, and said head portion accommodating an apex portion of said open loop extending above said protuberances.

4. The combination of claim 3 wherein said fastening means includes an elongated member extending through said apex portion of said open loop and securing said apex portion within said clip member.

5. The combination of claim 2 wherein said fastening means includes an elongated member extending within said apex of said open loop and retaining means connected to remote ends of said elongated member extending over an upper surface of said clip member.

6. The combination of claim 2 further including an inwardly extending protuberance carried by each said opposing side portion in opposing relationship, and said joint section accommodating an apex portion of said open loop extending above said protuberances.

7. The combination of claim 1 further including a pair of inwardly extending protuberances in opposing relationship carried by said opposing side portions, and said joint section accommodating an apex portion of said open loop extending above said protuberances.

8. The combination of claim 7 wherein said fastening means includes an elongated member extending through said apex portion of said open loop and securing said apex portion within said joint section of said clip member.

9. The combination of claim 1 wherein said fastening means includes an elongated member extending within said apex of said open loop and retaining means connected to remote ends of said elongated member and extending over an upper surface of said cable at the fold thereof.

* * * * *